United States Patent [19]

Marder

[11] Patent Number: 4,518,208

[45] Date of Patent: May 21, 1985

[54] APPARATUS AND METHOD FOR DISPENSING MEDICINE

[76] Inventor: Herbert B. Marder, 177 Lakewood Pl., Highland Park, Ill. 60035

[21] Appl. No.: 493,931

[22] Filed: May 12, 1983

[51] Int. Cl.[3] ..... A47B 81/00

[52] U.S. Cl. ..... 312/209; 40/490; 211/74; 312/234; 312/250; 312/281

[58] Field of Search ..... 312/250, 193, 140.2, 312/209, 234, 234.1, 234.3, 234.4, 234.5, 281; 211/71, 74; 116/323, 321; 40/490, 491

[56] References Cited

U.S. PATENT DOCUMENTS

| | | | |
|---|---|---|---|
| 1,272,149 | 7/1918 | Thompson | 40/490 X |
| 2,022,591 | 11/1935 | Everitt | 312/250 X |
| 2,255,744 | 9/1941 | Loeb et al. | 312/234 |
| 2,413,164 | 12/1946 | Boldt et al. | 312/250 X |
| 2,490,588 | 12/1949 | Frie et al. | 312/250 X |
| 2,575,661 | 11/1951 | Hickey | 312/209 X |
| 3,442,378 | 5/1969 | Wolfe | 211/74 |
| 3,520,583 | 7/1970 | Case | 312/250 X |
| 3,715,148 | 2/1973 | Beals | 312/250 X |
| 3,768,710 | 10/1973 | Eggers | 211/71 X |
| 3,817,588 | 6/1974 | Helmers | 312/234.1 X |
| 3,876,268 | 4/1975 | Colver | 312/234.5 X |
| 4,019,793 | 4/1977 | Gerding | 312/250 X |
| 4,054,343 | 10/1977 | Heyland | 312/234.1 |
| 4,114,965 | 9/1978 | Oye et al. | 312/209 |
| 4,127,311 | 11/1978 | Weiman | 312/234.3 X |

FOREIGN PATENT DOCUMENTS

| | | | |
|---|---|---|---|
| 968761 | 4/1972 | Canada | 211/71 |
| 62120 | 6/1951 | France | 312/234.5 |

*Primary Examiner*—Francis K. Zugel
*Assistant Examiner*—Thomas A. Rendos
*Attorney, Agent, or Firm*—Trexler, Bushnell & Wolters, Ltd.

[57] ABSTRACT

A cart on casters is provided for dispensing medication to patients as in a nursing home. The cart is provided with a plurality of laterally accessible bins. Each bin is labeled with a patient's identity, and further labels are provided to indicate at what times a given patient is supposed to have medicine. Each bin contains a patient card with medical information on the patient, and also includes one or more medicine containers, such as a blister pack card. One or more holes or recesses is provided in front of each bin in which medicine to be administered at a given time is pre-assembled in one or more paper cups, one cup for pills and the like, and the other for liquid medicine. Additional space is provided in the cart for carrying liquid medicines, non prescription medications, opthalmic solutions, etc. Space is also provided for supporting cups and a water pitcher, a pull out shelf is provided, and another folding shelf is provided, along with a waste container.

2 Claims, 5 Drawing Figures

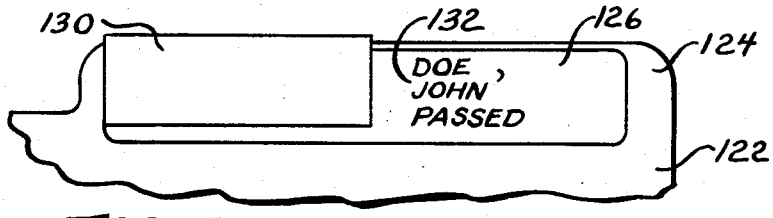
FIG. 5
FIG. 4
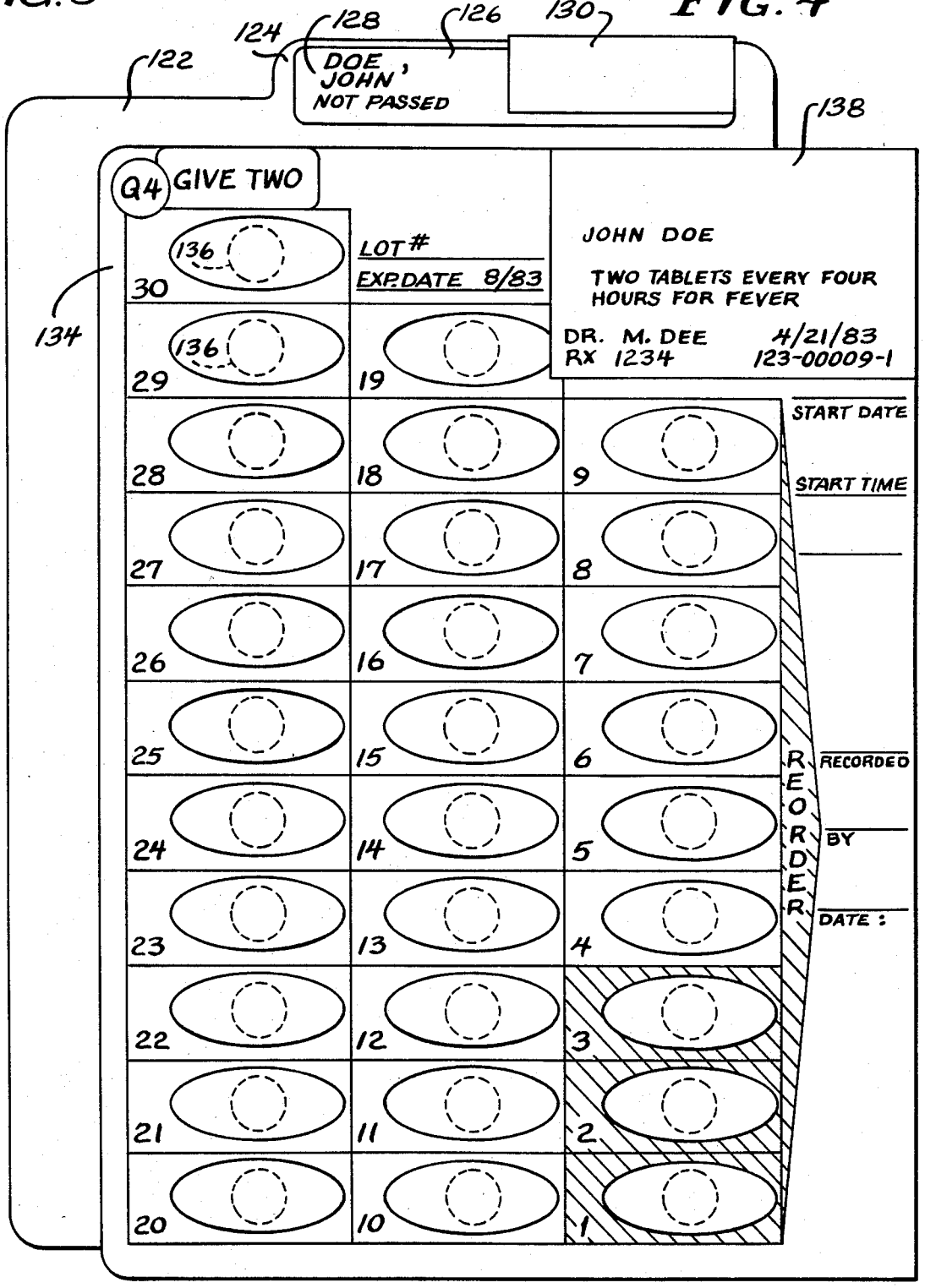

APPARATUS AND METHOD FOR DISPENSING MEDICINE

BACKGROUND OF THE INVENTION

The dispensing of medicine to large numbers of patients as in a hospital or nursing home presents many problems. It is often necessary to move medicines from a supply location to wherever the patients may be at a given time. In a hospital a patient is most usually found in his room, but nursing homes provide far greater problems as patients may be in a recreation area, or a lunch room, or otherwise in a location where many patients are present at the same time. Patients in nursing homes often are confused or forgetful, and a patient may simply wander away before a nurse can deliver to him all of his medicine and be sure that he takes it. Conversely, a confused patient may forget that he has already had his medicine, and try to help himself thereto. Constant attention is demanded on the part of the nurse dispensing medication to be sure that patients do not take medicine that they are not supposed to, and that patients actually take the medicine that they are supposed to. This also leads to more time expended in dispensing of medicines than can be afforded, and leaves opportunities for possible errors in the dispensing of medicine.

OBJECTS AND SUMMARY OF THE PRESENT INVENTION

It is an object of the present invention to provide a mobile cart from which medicines may be quickly dispensed as in a nursing home.

It is a further object of the present invention to provide such a cart having a plurality of bins, one for each patient, with all of the medications and prescription cards for a given patient in a single bin.

Yet another object of the present invention is to provide a cart as aforesaid in which all of the medications for each patient are presorted for individual and rapid dissemination to each patient.

In attaining the foregoing and other objects I provide a mobile cart having casters thereon facilitating rapid movement from a storage location to one or more medicine dispensing locations. The cart is provided with a plurality of bins, one for each patient. A name card is provided for the patient in the bin assigned to each patient, while prescription medications in blister pack cards are respectively stored in the patient bins. Each bin is identified as to patient, and color coded tabs are provided in front of each bin to indicate at what times particular patients are supposed to take medicines. An area is provided in front of each bin for one or more paper cups for presorting the medicines to be dispensed to each patient. Additional storage positions are provided for liquid medicines and non-prescriptions medicines, while work space for a nurse is provided as is space for trash disposal. Lockable doors are provided for locking up the medicines during times when they are not being dispensed.

THE DRAWINGS

The present invention will best be understood with reference to the following specification when taken in connection with the accompanying drawings wherein:

FIG. 1 comprises a perspective view showing one form of the present invention;

FIG. 4 is a plan view of the patient card and an associated pill package; and FIG. 5 is a detailed view of a portion of FIG. 4 illustrating a particular feature of the present invention.

DETAILED DESCRIPTION OF THE ILLUSTRATED EMBODIMENT

Figure 1:
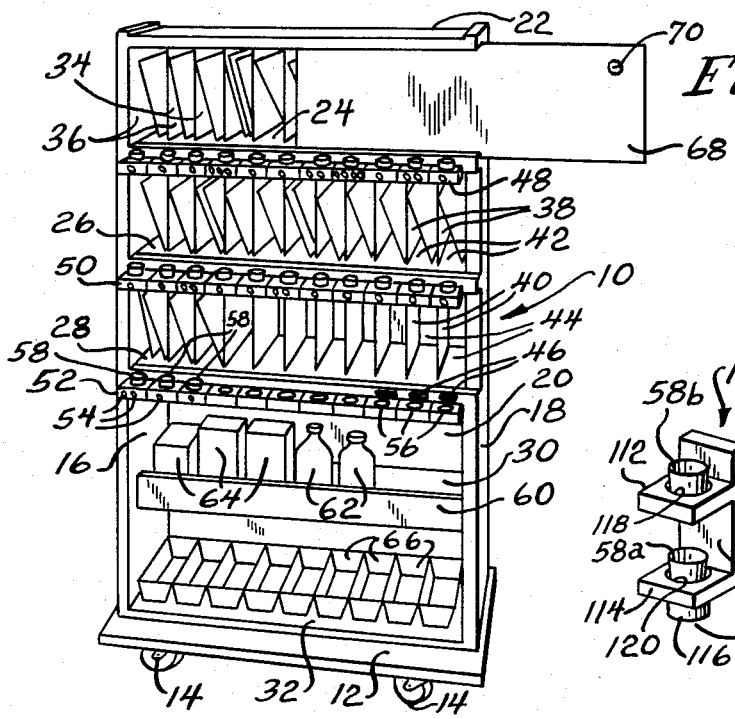

Referring now in greater detail to the drawings and first to FIG. 1 there is shown a cart 10 constructed in accordance with the principles of the present invention. The cart includes a bottom wall or floor 12 having four casters 14 secured to the underside thereof. The cart further includes a pair of side walls 16 and 18 upstanding from the floor 12 and joined by a rear wall 20. A top wall 22 is joined to the side walls 16 and 18 adjacent the upper limits thereof, and is joined to the top edge of the back wall 20. The cart can vary in size in accordance with requirements of a given nursing home or other installation but conveniently is about chest high.

The cart includes upper shelves, specifically top shelf 24, a first underlying shelf 26, and a second underlying shelf 28. The cart further includes a shelf 30 disposed below the shelf 28 and a bottom shelf 32 lying on the floor 12. Each of the shelves is joined to the side walls and the back walls.

A plurality of vertical partitions 34 is provided at horizontally spaced intervals between the top wall 22 and the top shelf 24, each pair of partitions, and also the end walls 16 and 18, defining a respective one of a plurality of bins 36. Regularly horizontally spaced partitions 38 between the top shelf 24 and the first underlying shelf 26 and similar partitions 40 between the first and second underlying shelves 26 and 28 define additional bins 42 and 44. Adhesive labels bearing a patient's name are provided at 46 in front of each bin. Only a few such labels are shown to avoid confusing the drawings with too much detail.

Each bin has disposed therein in substantially vertical position a patient card and one or more medicine cards as may be appropriate, and as will be discussed hereinafter at greater length.

Each of the shelves 24, 26 and 28 has a short and slightly lowered sub shelf 48, 50 and 52 respectively extending forwardly therefrom. The sub shelves are provided with painted on lines to define spaces corresponding to the adjacent bins. Each such space on a sub shelf has one or more adhesive dots 54 fixed on the front edge thereof. These dots are color coded and indicate the time of day at which a particular patient is supposed to receive medication. Thus, one particular color would indicate first thing in the morning, another at noon, another at bedtime, etc. Each sub shelf is provided on its upper surface with a plurality of holes 56 respectively corresponding to the spaces on the sub shelf associated with the corresponding bins. These spaces receive paper medicine cups 58 in which the medicine(s) for a respective patient are placed before dispensing thereof to the patients.

The shelf 30 is provided at its front edge with an upstanding flange 60 to retain liquid medicines in bottles such as at 62, or medicines in boxes at 64. The bottom shelf 32 is provided with a plurality of removable trays 66 which may receive packages of non prescription medicines, cotton swabs, etc.

Sliding doors are provided for closing the fronts of the shelves, only one such door being shown at 68. Each such door is provided with a lock 70. Thus, the medicines may be kept securely locked when it is not time for dispensing medicines. When it is desired to use the cart for dispensing medicines the doors are simply removed and stacked against a wall in a convenient location.

When a patient is first admitted to a nursing home or hospital a bin 36 is set up specifically for him. A patient card is placed in the bin, and one card of medicine is inserted for each different medicine that the patient is supposed to have. His name is applied in front of the bin by the sticker 46, and colored tabs 54 are applied to indicate what time or times of day the patient is supposed to have medicine. Before each medicine dispensing time a nurse goes through the entire cart, patient by patient. For each patient the medicine to be dispensed at that particular time is placed in the corresponding cup 58. Medicine may be dispensed at a central location, or it may be dispensed to patients on a room by room basis. Since all of the medicines are already in the paper cups the nurse can quickly dispense medicine to each patient while simultaneously keeping an eye on the cart to make sure that patients do not help themselves to medicine.

Figure 2:
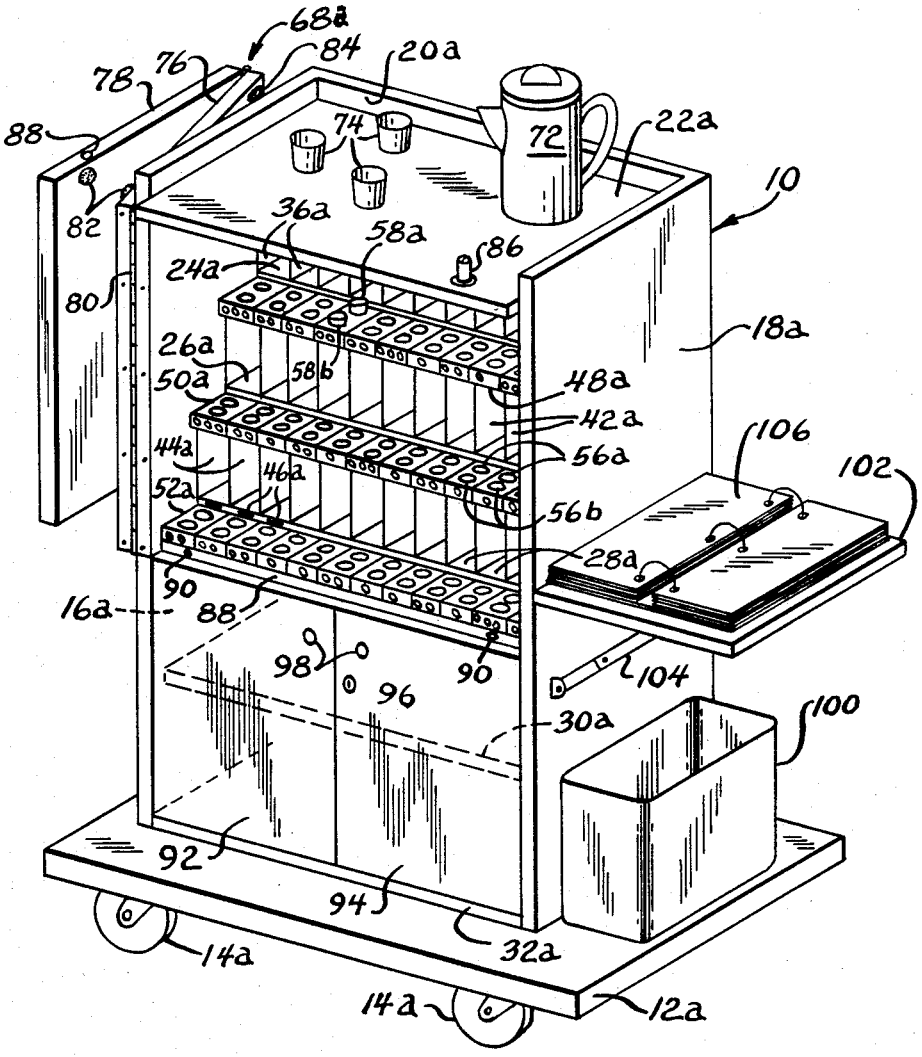
FIG. 2 is a similar view showing an improved and preferred form of the present invention.

An improved form of the invention is shown in FIG. 2 and similar parts are identified by similar numerals with the addition of the suffix a to avoid repetition of discussion. The general arrangement of the cart is as it was before, but the bins and the accompanying shelves are tiered or stair stepped with the shelf 26*a* being recessed relative to the shelf 28*a*, and the shelf 24*a* being further recessed with regard to shelf 26*a*. Internal stops may be provided in the bins if desired to prevent cards and the like from being pushed too far in. As will be observed, the overall depth of the cart is somewhat greater to accommodate this stair stepping or tiered arrangement.

A further distinction is that the sub shelves 48*a*, 50*a* and 52*a* are deeper and are provided with two sets of cup receiving holes 56*a* and 56*b* whereby two cups 58*a* and 58*b* may be provided for each patient. Only two such cups are shown in the upper sub shelf 48*a* for simplicity of illustration. Thus, both pills and liquid medication may be provided for a patient. The top wall 22*a* is recessed somewhat so that the sidewalls 18*a* and 16*a*, and also the rear wall 20*a* extend above the top wall 22*a* to form an encircling wall, whereby a water pitcher 72 and a plurality of cups 74 may be placed on the top wall to provide a ready source of drinking water for patients to swallow pills.

Instead of the removable sliding doors or panels 68, in FIG. 2 there is provided a single door 68*a* having two panels 76 and 78. The panel 76 is hingedly connected at 80 to the side wall 16*a*, while the second panel 78 is hingedly connected to the panel 76. In open position the panels may be secured together by two Velcro patches 82. An additional Velcro patch 84 is placed on the panel 76 near the hinge for cooperation with a similar Velcro patch on the side wall 16*a* to hold the folded doors in completely open position. The doors close in front of the shelves, and a plunger door lock 86 is provided in the top wall 22*a* with the plunger thereof cooperating with a recess 88 in the top edge of the door panel 78.

Below the bottom shelf 28*a* and sub shelf 52*a* there is provided a pull out shelf 88 having finger engaging pull devices 90 thereon. This provides a work surface for the nurse for prefilling the various cups of medicines or medications, and includes the possibility of utilizing a mortar and pestle to grind pills as may be necessary.

The two underlying shelves 30*a* and 32*a* are deeper than in the previous embodiment of the invention, and two hinged doors 92 and 94 are provided to cover these shelves, the doors being provided with a lock 96 and handles or the like 98 for opening of the doors. As will be apparent, a manually releasable latch could be provided on the inside of the door 92 with the lock 96 in the right door 94, in accordance with known practices.

The floor 12*a* extends to the right of the right wall 18*a* to provide space for a wastebasket 100 for disposing of used medicine cups 58*a* and 58*b*, and also used drinking cups 74.

A folding shelf 102 is hinged on the right side wall 18*a* and is supported by a folding brace 104 for receipt of patient cards in conventional fashion, or for other necessary notes or literature in looseleaf form as shown at 106.

Operation of the embodiment of the invention in FIG. 2 is substantially the same as that of the embodiment in FIG. 1. However, it will be apparent that the embodiment of FIG. 2 is considerably more convenient for the nurse, being completely self-contained and not requiring a separate table or counter for grinding of pills, loading of pill cups or liquid medication cups 58*a*, 58*b*, or making of notes. It is more convenient to have the two holes for receipt of both liquid and dry medication cups, and the tiered arrangement makes for greater convenience from one level to the next.

Reference heretofore has been made to pills in blister pack cards, but it will be apparent that other types of medication carriers such as vials, bottles, boxes, etc. can be used. It is for this reason that the bins are substantially wider than would be necessary simply to carry a few cards. No mention has been made of the material of the cart to this point, but it will be apparent that it can be made of metal, wood, or pressed wood covered with a suitable hard plastic, painted wood, or other suitable material.

Figure 3:
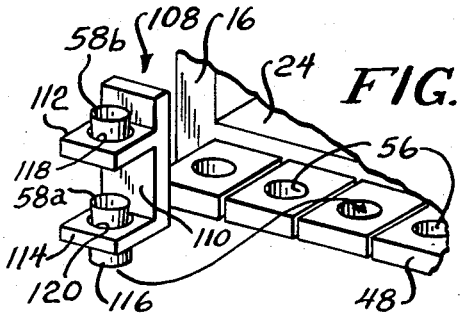
FIG. 3 is a detailed perspective view on an enlarged scale of a structure especially adapted for the invention as shown in FIG. 1, but also usable with the invention as shown in FIG. 2.

An adapter for providing both a pill cup and a liquid cup 58*a* and 58*b* for use with the single hole sub shelf as 48 in FIG. 1 is shown in FIG. 3. The adapter 108 comprises an upright back wall 110 with horizontal upper and lower shelves 112 and 114 respectively projecting forwardly therefrom. The lower shelf has a plug 116 on the underside thereof for receipt in one of the holes 56 of the sub shelf 48. Holes 118 and 120 are provided in the shelves respectively for receipt of the cups 58*b* and 58*a*. It will be apparent that the modified cart of FIG. 2 could have but one hole for each patient position in the sub shelf and that the adapter could be used therewith, or that one or more adapters could be used with the two hole configuration of FIG. 2 if it should be necessary to provide two liquid medications at the same time to a patient, as well as pills.

A conventional patient card 122 is shown in FIG. 4. This card is approximately 6×9 inches and is conventionally retained in a looseleaf notebook. The card has a raised portion 124 thereon for receipt of an adhesive label 126 bearing the patient's name. As a part of the present invention the name is twice applied, as shown in FIG. 4 to the left of the label at 128, and further bearing the words "NOT PASSED". The patient's name also appears at the right portion of the label as indicated at 132 in FIG. 5 along with the word "PASSED". An opaque plastic slider 130 in the nature of a clip embracing both surfaces of the card is positioned to the right as shown in FIG. 5 so that the nurse immediately can see that the patient has not yet been passed his medicine. When the medicine is passed, the nurse slides the slider to the left as in FIG. 5 to indicate that the medicine has been passed to the patient. Other conventional information appears on the card and need not be shown here since it is common practice. Among such information are indications of what medications, both prescription and non prescription, are to be given to the patient, and at what time or intervals they are to be given.

Lying on top of the patient card 122 in FIG. 4, and displaced somewhat therefrom for visability of the patient card there is a blister pack card 134 having pills 136 secured therein. There will be one such card or other medication package for each medication to be given to the patient. A prescription card 138 is secured to the upper right corner of the medication card 134, as by stapling or adhesive securing, and this card gives the patient's name and the prescription, as well as the doctor's name, prescription number, and date. As noted, there will be one such card or other container for each medication to be given to the patient, and each such card or other container will have a prescription card thereon.

As will now be fully understood, each bin in the cart is assigned to a given patient. The patient's name appears in front of the bin, and color coded dots are adhesively secured in front of each bin to indicate the time or times at which a patient is to be given medication. Each patient's bin has therein a patient card, and one or more blister pack pill cards or other medication containers, there being one for each medication to be supplied to the patient. Shortly before each given time during the day when patients are to receive medication the nurse prepares the cart in a secluded area, such as a room secured against entry by the patients. Such preparation includes placing in a paper cup in front of each patient's bin the medication or medications to be taken at that time by the patient, whether in pill or liquid form. After such preparation has been made for all patients the cart is wheeled either to a location where all patients are to be found, such as a dining room or a recreation room, or to patient's rooms, or some combination thereof. Since the medications are already set out in cups the nurse can dispense them with considerable rapidity, thus insuring against patients wandering away before the medication can be given to them. This does not require the complete concentration of the nurse due to the previous setting out of the medicines as described, so that the nurse can keep an eye on the cart and on patients to make sure that no one takes medication that he is not supposed to.

The specific examples of the present invention as herein shown and described will be understood as being for illustrative purposes only. Various changes in structure and in process will no doubt occur to those skilled in the art and will be understood as forming a part of the present invention insofar as they fall within the spirit and scope of the appended claims.

The invention is claimed as follows:

1. A cart for use in supplying medications to a plurality of patients comprising a base, wheel means on said base for moving said cart about, means upstanding from said base providing a plurality of laterally accessible bins each having an entrance, said plurality of bins having a common top wall and a common bottom wall and a common rear wall, and the bins respectively being further defined by fixed upstanding side walls, each bin being relatively high and narrow, each bin being assigned to a respective patient, means adjacent each bin identifying the patient to which it is assigned, each bin containing a patient card on edge in substantially upright position and a long term supply of disparate medicines for that patient, horizontal support means adjacent each bin entrance substantially forming a continuation of said bottom wall, said support means having a plurality of upwardly opening recesses therein respectively aligned with said bins and each comprising a substantially circular aperture sized to receive a disposable cup, and a disposable cup in each of at least selected ones of said recesses of said support means for holding the medicine to be dispensed to the respective patient at a given time according to the adjacent patient card in the respective bin.

2. A cart as set forth in claim 1 and further including an adapter having a pair of vertically spaced parallel horizontal shelves, said shelves each having an upwardly opening recess similar to said support means recesses and each adapted to receive a disposable cup, upstanding support means supporting said shelves in vertically spaced, parallel relation, and a depending plug on the underside of the lower of said pair of shelves sized to be received in a recess in said support means to permit supporting two disposable cups corresponding to one support means recess.

* * * * *